United States Patent [19]

Graves

[11] Patent Number: 4,484,185

[45] Date of Patent: Nov. 20, 1984

[54] SAFETY PLUG ADAPTER

[76] Inventor: James D. Graves, 511 W. Stephen St., Martinsburg, W. Va. 25401

[21] Appl. No.: 522,764

[22] Filed: Aug. 12, 1983

[51] Int. Cl.[3] ..... G08B 21/00; H01R 13/62

[52] U.S. Cl. ..... 340/656; 174/66; 337/1; 337/242; 339/36; 339/75 P

[58] Field of Search ..... 340/656; 339/75 R, 75 M, 339/75 MP, 75 P, 76, 77, 78, 79, 82, 84, 103 R, 104, 105, 36; 174/66, 67; 337/1, 3, 4, 5, 72, 197, 198, 79, 241, 242, 265, 266, 332, 376

[56] References Cited

U.S. PATENT DOCUMENTS

| | | | |
|---|---|---|---|
| 1,835,251 | 12/1931 | Wetstein | 339/75 P |
| 2,610,999 | 9/1952 | Silver | 339/36 |
| 2,913,791 | 11/1959 | Martin | 339/104 X |
| 3,258,564 | 6/1966 | Conigliaro | 337/72 |
| 3,530,337 | 9/1970 | Moore | 340/656 X |
| 3,833,875 | 9/1974 | Holoka | 337/198 X |
| 3,924,914 | 12/1975 | Banner | 340/656 X |
| 4,089,032 | 5/1978 | Dell Orfano | 340/656 X |
| 4,349,238 | 9/1982 | Showman et al. | 339/75 M |

*Primary Examiner*—James L. Rowland
*Assistant Examiner*—Daniel Myer
*Attorney, Agent, or Firm*—Edwin E. Greigg

[57] ABSTRACT

A safety plug to an outlet box receptacle, which includes an overcurrent protection device, and engaging devices for engaging the safety plug adapter both to flanged portions of the outlet box face plate and to the electric cord so that it is difficult for a small child to remove the electric cord connecting plug from the adapter, or the adapter from the outlet box receptacle. The adapter may also include a voltage-actuated light-emitting device to indicate when the outlet box receptacle is energized, and a spring-loaded adapter receptacle cover plate.

11 Claims, 10 Drawing Figures

FIG.6
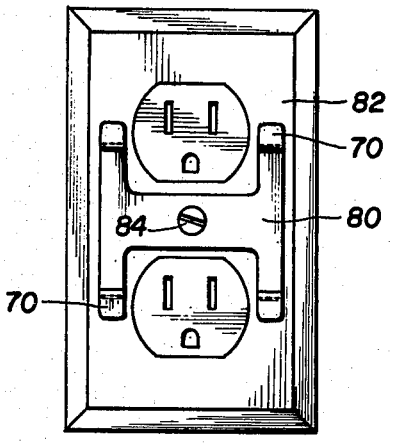
FIG.7
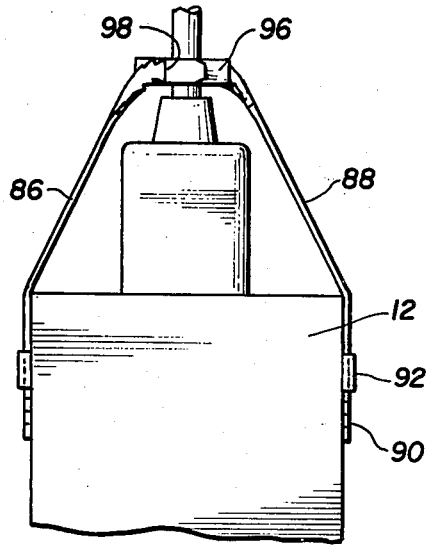
FIG.8
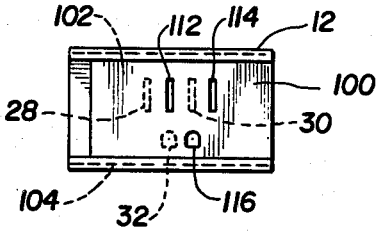
FIG.9
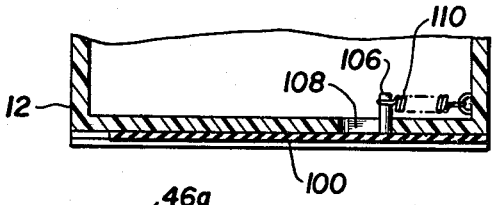
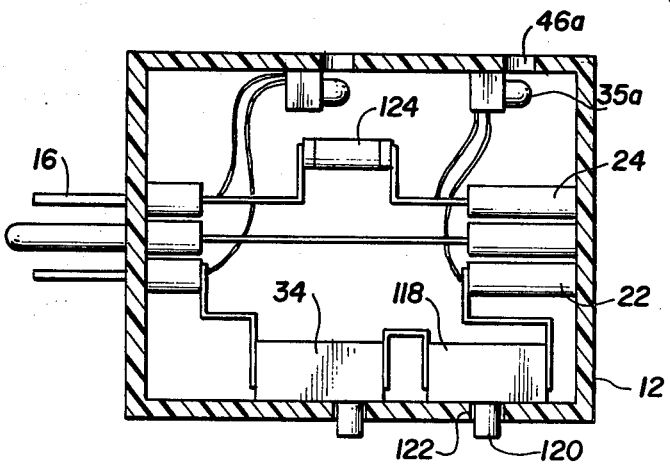
FIG.10

SAFETY PLUG ADAPTER

BACKGROUND OF THE INVENTION

The invention relates generally to a safety plug adapter, which includes an overcurrent protection device, connected between a single phase, grounded, polarized electrical receptacle and a two or three prong electric plug for supplying electric power to an electrical appliance or device. More particularly, the invention relates to this type of safety plug adapter which includes safety features for protecting small children against contact with an energized electrical circuit.

Known safety plug adapters, such as those described in U.S. Pat. No. 3,368,110, issued Feb. 6, 1968 to R. A. Taylor, or in U.S. Pat. No. 2,649,522, issued Aug. 18, 1953 to M. J. Marcus, include fuses which will limit the magnitude and duration of overload or short circuit current. Thus, if a small child inserted a wire into the appertures of one of these known safety adapters which was plugged into a conventional wall receptacle to thus cause a short circuit current to flow through the wire, these fuses would provide some degree of protection to the child from burning caused by the heating and/or melting of this wire. However, the child could still be seriously injured. Also, there is nothing to prevent a small child from disconnecting one of these known safety plug adapters from the wall receptacle, and thereafter inserting a wire in the openings of the wall receptacle, in which case, a child could be seriously burnt by molten metal or subjected to severe electrical shock before a fuse or circuit breaker in the electrical supply line for the wall receptacle operates to disconnect this wall receptacle.

There are known plastic plugs of insulating material, which, when inserted in an electrical receptacle, are difficult for small children to remove. In households containing small children, these known insulating plugs can be used to cover unused electrical receptacles to protect such small children from contact with an energized conductor of the unused receptacle. However, there is also a need to better protect small children from contact with an energized electrical conductor of a receptacle which is normally used, since it is relatively easy for a small child to disconnect an electrical appliance, or device, such as a lamp, by merely tugging or jerking on the electric cord for this appliance.

OBJECTS AND SUMMARY OF THE INVENTION

Therefore it is a primary object of the invention to provide a safety plug adapter including an overcurrent protection device, which can be easily removed from an electrical receptacle into which this safety plug adapter is engaged by an adult person, but which is very difficult for a small child to disconnect from the receptacle.

It is a further object of the invention to provide a safety plug adapter which is difficult for a small child to disconnect from the connecting cord plug of an electrical device engaged with the safety plug adapter.

It is another object of the invention to provide a safety plug adapter having a voltage-actuated light-emitting device for indicating whether an electrical receptacle engaged by the safety plug adapter is energized.

It is a still further object of the invention to provide a safety plug adapter having a spring-loaded receptacle cover plate for covering the receptacle of the safety plug adapter whenever the line plug of an electrical appliance or device is not engaged with this receptacle.

In a preferred embodiment of this invention, three contact prongs extend outwardly from one end of an adapter housing for engaging a single phase, grounded, polarized, electric receptacle mounted in an electrical outlet box. The safety plug adapter includes a similar receptacle for receiving a single phase, 3 prong, polarized electric plug at an opposite end of the adapter housing. The three contact members of the adapter receptacle are electrically connected by three connecting lines to the three corresponding contact prongs extending from the one end of the housing. The connecting line to be connected to the energized line of the power supply circuit includes an overcurrent protection device, such as a circuit breaker or fuse which is disposed within the adapter housing. A voltage actuated light-emitting device, such as a light-emitting diode, is disposed within an opening on one side of the adapter housing and is electrically connected between the energized line contact prong and the system ground contact prong, so that when these prongs are housing and has an opposite end which is adapted for connection to the electrical cord of an electrical appliance or device. Thus, one of these safety plug adapters, having the correctly sized overcurrent protection device for a particular electrical apparatus, can be permanently connected to this electrical apparatus.

A face plate, which is mounted to the outlet box, includes an access opening for the electrical receptacle mounted within the outlet box, and has openings or L-shaped extensions disposed on opposite sides of the access opening to define two flanged portions for engaging members affixed to opposite sides of the adapter housing. For example, these engaging members may be spring steel strips, each having one end fixed to the adapter housing and an opposite free end which is bent to engage the flanged portions of the outlet face plate. These steel spring strips are disposed so that they must be either pushed inwardly or pulled outwardly when the adapter is inserted into the outlet box receptacle in order to move past the two flanged portions of the outlet face plate. After the adapter has been fully inserted in the outlet box receptacle, the spring steel strips are released to allow the bent ends of these strips to engage the flanged portions of the face plate and prevent the adapter from being disconnected from the outlet box receptacle without again exerting inward or outward pressure on these two spring steel strips.

The receptacle end of the adapter housing may also carry a moveable receptacle cover plate which is spring-loaded to cover the adapter receptacle whenever this receptacle is not engaged with the electrical cord plug of an electrical device.

The invention will be better understood, as well as further objects and advantages will become more apparent from the ensuing detailed description of the preferred embodiments, taken in conjunction with the drawings.

BRIEF DESCRIPTION OF THE DRAWINGS

FIGS. 3–6 are partial sectional views of engaging elements of the plug adapter and receptacle face plate, for various embodiments of the invention.

FIG. 7 is a partial plan view of another embodiment of the invention showing adjustable length straps for securing the cord plug of an electrical device to the plug adapter.

FIG. 8 is a perspective view of another embodiment of the invention, which the plug adapter includes a receptacle cover plate.

FIG. 9 is a partial sectional view of the embodiment of FIG. 8.

FIG. 10 is a plan view of another embodiment, in which the plug adapter includes a manual switching device.

DETAILED DESCRIPTION OF THE PREFERRED EMBODIMENTS

Figure 1:
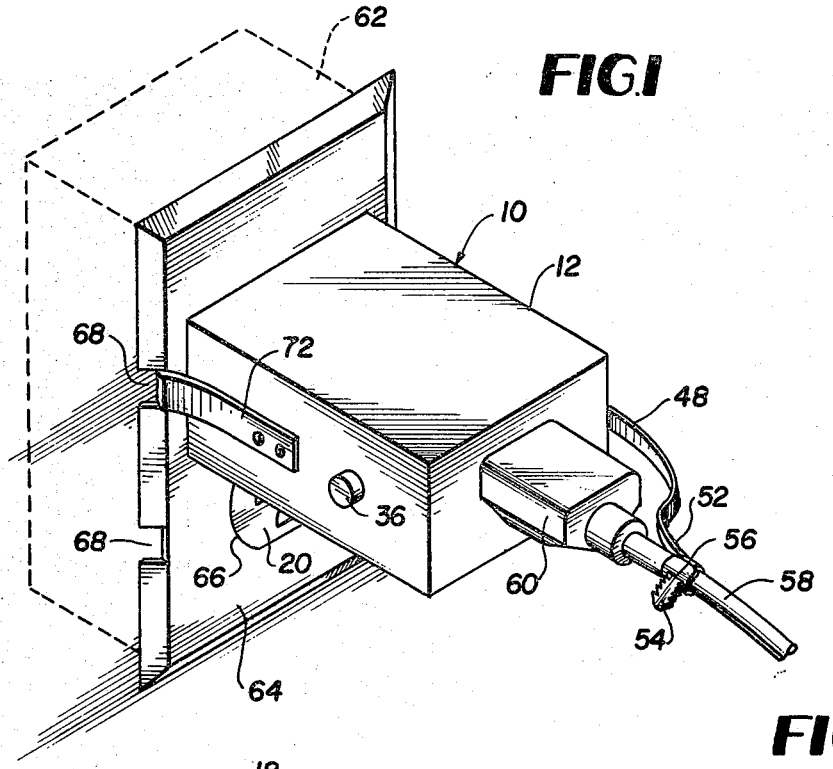
FIG. 1 is a perspective view of a safety plug adapter, according to the invention, connected between an electric output box receptacle and an electric cord plug.
Figure 2:
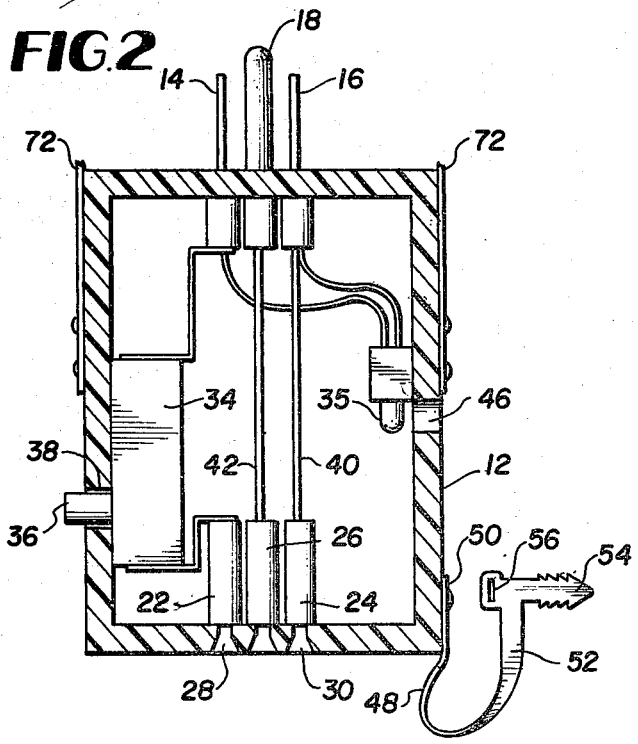
FIG. 2 is a plan view of the plug adapter of FIG. 1, with the top portion of the adapter housing removed to show interior elements of the plug adapter.

Referring now to FIGS. 1 and 2, a safety plug adapter 10 includes an adapter housing 12 of electrically insulating material. Three electrically conductive contact prongs 14, 16, 18, which extend outward through one end of the housing 12, are disposed as a single phase, three prong, polarized electric plug, which is insertable into a standard single phase, grounded, polarized outlet box receptacle 20. When these prongs 14, 16, 18 are so engaged, the contact prong 14 is connected to an energized line of a single phase, low voltage, distribution system, the contact prong 16 is connected to the ground line of the power distribution system, and the contact prong 18 is connected to a contact of the outlet box receptacle which is separately grounded.

Three contact members 22, 24, 26 are disposed within the adapter housing 12 adjacent respective openings 28, 30, 32, through an opposite end of the adapter housing 12, which form, with the contact members 22, 24, 26, a single phase, grounded polarized electrical receptacle, similar to the outlet box receptacle, for receiving either a two-prong or three-prong polarized, single phase electric plug connected by an electric cord to an electrical device.

The safety plug adapter 10 also includes a known overcurrent protection device such as a bimetallic thermally-operated switching device 34 having a manual reset button 36 extending through an opening 38 on one side of the adapter housing 12. The system ground contact prong 16 is connected to the contact member 24 by an electrically conductive member 40, and the separately grounded contact prong 18 is connected to the contact member 26 by another electrically conductive member 42. An electrically-actuated light-emitting device 35, such as an incadescent or neon lamp, or a light-emitting diode, is disposed within or adjacent to, an opening 46 of an opposite side of the adapter housing 12 and is electrically connected between the contact prongs 14 and 16. The safety plug adapter 10 also includes a flexible strap 48 having one end 50 affixed to the opposite side of the adapter housing 12, and having a free end 52 which is adapted for connection to the electric cord of an electrical appliance or device. For example, the free end 52 of strap 48 may have a flexible serrated portion 54 which can be wrapped around the electric cord of an electrical device and secured within an opening 56 of the strap 48. This is illustrated in FIG. 1, which shows an electric cord 58 of an electrical device which is electrically connected to the contact members 22, 24, 26 of the safety plug adapter 10 by a three-prong polarized connecter plug 60, and which is also mechanically connected to the safety adapter 10 by the flexible strap 48.

Figure 3:
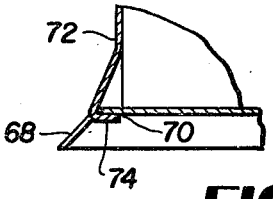

FIG. 1 shows a conventional electrical outlet box 62, having two single phase, grounding type polarized electric plug receptacles 20 mounted therein, and a face plate 64, having two receptacle access openings 66 to allow the insertion of connector plugs into the receptacles 20. Also, the face plate 64 includes four notched portions 68 disposed on opposite sides of the face plate 64 adjacent to the receptacles 20, which define and allow access to four flanged portions 70 of the face plate 64. The safety plug adapter 10 includes two spring-loaded engaging elements 72 disposed on opposite sides of the adapter housing 12. Each engaging element 72 has one end affixed to the adapter housing 12 and an opposite free end 74 which is spring-loaded to engage an adjacent one of the face plate flange portions 70 when the safety adapter plug 10 is fully inserted into one of the outlet box receptacles 20, as shown in FIG. 1. The engaging elements 72 may be formed of resilient material, such as spring steel, to provide its own spring loading. As shown in FIGS. 1 and 3, the safety plug adapter 10 cannot be disconnected from the outlet abox receptacle 20 solely by pulling on the safety plug adapter 10, since the bent ends 74 of the two engaging elements 72 will engage the flange portions 70 of the face plate 64 to prevent such disengagement. Rather, opposite, outwardly directed forces must be applied to the engaging elements 72 so that these engaging elements 72 clear the face plate flange portions 70 while a force in another direction is applied to the safety plug adapter 10 to disengage it from the outlet box receptacle 20.

Figure 4:
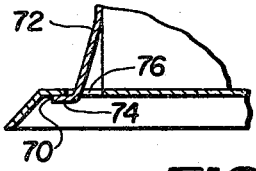

FIG. 4 illustrates a variation of these engaging elements 72 in which the notched portions 68 of the face plate 64 are replaced by the openings 76 through the face plate 64 which define the flanged portions 70 of the face plate, and the engaging elements 72 are spring-loaded in an outward direction. Thus, the free ends of the two engaging elements 72 must be pressed inwardly so that these free ends 74 can be inserted in the openings 76 when the plug adapter 10 is inserted into the outlet box receptacle 20. Then, in order to remove the plug adapter 10 from the outlet box, the free ends of the engaging elements 72 as shown in FIG. 4 must be pressed inwardly to disengage these free ends 74 from the flanged portions 70.

Figure 5:
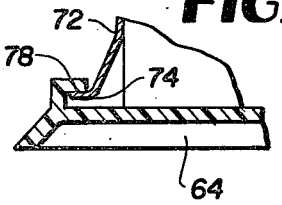

FIG. 5 shows another variation of the adapter engaging elements 72 and the face plate flanged portions 70, in which the face plate 64 is formed of molded material and has L-shaped extensions 78 which define the flanged portions which are engaged by the free ends 74 of the engaging element 72. Also, as shown in FIG. 6, the flanged portions 70 may be defined by a formed metal plate 80 which is connected to a conventional face plate 82 by the same mounting screw 84 which is used to connect the face plate 82 to the outlet box 62.

FIG. 7 illustrates another variation of the invention in which two adjustable length, flexible straps 86, 88, which are disposed on opposite sides of the adapter housing 12, are used instead of the single flexible strap 48 to secure the safety plug adapter 10 to the electric cord plug of an electrical appliance or device. The straps 86, 88 are adjustably connected to the adapter housing 12. For example, the end 90 of the flexible strap 86 or 88 may be serrated for insertion through an opening 92 of a bracket 94 affixed to the side of the adapter housing 12. Also, the free end 96 of the strap 86 or 88 can be serrated so that they can be inserted and anchored within an opening 98 of the other flexible strap 86 or 88. By using two such adjustable straps, the connection plug of the electrical appliance or device can be tightly secured to the safety plug adapter 10.

In the embodiment illustrated in FIGS. 8 and 9, a receptacle cover plate 100 of electrically insulated material is slideably mounted on the receptacle end of the adapter housing 12. The adapter housing 12 is formed to define parallel grooves 102, 104 within which opposite sides of the receptacle cover plate 100 extend. These parallel grooves 102, 104 serve as guides for the receptacle cover plate 100 and define a linear path of travel for the receptacle cover plate 100. A pin 106, which is affixed at one end to the receptacle cover plate 100, extends from the receptacle cover plate 100 through an elongated opening or slot 108 to an opposite end which is connected to one side of the adapter housing 12 by a spring 110. The slot 108 determines two extreme positions of the receptacle cover plate 100 and the spring 110 exerts a force on the receptacle cover plate 100 to maintain it in a first one of these two extreme positions.

The receptacle cover plate 100 has three openings 112 and 114, 116 of the same size, shape, and relative spacing as the openings 28, 30, 32, respectively, for receiving a single phase, three prong polarized electric plug. When the receptacle cover plate 100 is disposed in its second extreme position, or opened position, the openings 112, 114, and 116 of the receptacle cover plate 100 are aligned with the openings 28, 30, 32, respectively, of the adapter housing 12, so that a three prong, polarized electric plug can be inserted through both sets of openings to make contact with the contact members 22, 24, 26, respectively, disposed within the adapter housing 12.

To connect the plug and cord of an electrical appliance or device to the safety plug adapter 10, having a receptacle cover plate 100 as shown in the embodiment of FIGS. 8 and 9, it is necessary to move the receptacle cover plate 100 to its second position to allow entrance of the appliance plug into the adapter receptacle. Conversely, when this appliance plug is disconnected from the safety plug adapter 10, the receptacle cover plate 100 will be automatically moved into its first extreme position, or closed position, at which all of the receptacle openings 28, 30, 32 are covered by the cover plate 100.

There are many variations of a movable receptacle cover plate in addition to the receptacle cover plate 100 described herein. For example, the receptacle cover plate could be pivotally connected to the adapter housing 12 for pivotal movement between its opened and closed position, rather than movement along a linear path of travel. The receptacle cover plate could be moved along a liner path of sufficient length so that it completely clears the electric cord connecting plug, in which case, the openings 112, 114, and 116 would be unnecessary. Additional features could be included to make it still more difficult for a small child to uncover the adapter receptacle openings 28, 30, 32. For example, the parallel grooves 102, 104 could be slightly offset to be spaced further apart when the receptacle cover plate is in its closed position, so that it is necessary to raise the receptacle cover plate 100 slightly to clear an offset shoulder before the receptacle cover plate 100 can be moved to its opened position, or locking pawl members may be pivotally connected to the adapter housing 12 for rotation by gravity or spring means to hold the receptacle cover plate in its closed position so that these members must be rotated to allow the receptacle cover plate to be moved to its opened position.

Since many electrical appliances do not have on/off switches but are merely plugged into an electrical circuit, an additional single pole switch 118, having an operating handle 120 extending through an opening 122 of the adapter housing 12, can be disposed within the adapter housing 12 and connected electrically in series with the thermal overload device 34, as shown in FIG. 10. Also, to provide some degree of overcurrent protection even when the outlet box receptacle 20 has been improperly wired, an additional fuse 124, having an ampere rating at least twice that of the thermal switching device 34, can be disposed within the adapter housing 12 and connected electrically between the system ground contact prong 16 and the contact member 24. Assuming the outlet box receptacle 20 is correctly wired, the thermal overload device 34 will always operate before this additional fuse 124 is damaged. However, if the receptacle 20 has been incorrectly wired so that an overload or fault current will not flow through the thermal overload device 34, the additional fuse 124 will operate to open the circuit.

Also shown in FIG. 10 are two light emitting devices rather than one, namely, the primary device 35 and a secondary device 35a similar to the primary device and electrically connected between the contact prongs 22 and 24. The secondary device is shown to be located at one end of the adapter housing opposite that where the primary device is located and is adjacent a suitable opening 46a.

The primary light emitting device enables one to know whether or not the power supply is on or off, whereas the secondary light emitting device when lit informs the user of the adapter that the power supply is on and further that the breaker is set, the fuse 104 is operational or unblown, and the switch 118 is in the "on" position. If the secondary light is not on, then either the switch is off, the breaker has been kicked open, or the fuse has been blown due to overload or short circuiting through the adapter.

If the primary device is lit and the appliance or unit fails to operate then either the unit is not plugged in or it has a malfunction.

If both the primary and secondary devices are off, that is, no light from either is emitted, then either the fuse is blown, the breaker is kicked open, or the electric power is off.

The foregoing relates to a preferred exemplary embodiment of the invention, it being understood that other variants and embodiments thereof are possible within the spirit and scope of the invention, the latter being defined by the appended claims. What is claimed and desired to be secured by letters patent of the United States is:

1. In combination, an outlet face plate assembly and a safety plug adapter for an electrical outlet box containing at least one receptacle for receiving a single phase, three prong, polarized electric plug, each receptacle having three recessed contacts for engaging the three plug prongs, respectively, the three receptacle contacts including a first contact connected to an energized line of a power system, a second contact connected to a ground line of the power system, and a third contact separately connected to ground, wherein the face plate assembly defines an access opening to each receptacle and includes first and second flanged portions disposed on opposite sides of each access opening and mounting means for securing the face plate to the outlet box, and the safety plug adapter comprises:

an adapter housing formed of electrically-insulating material;

first, second, and third contact prongs, extending outwardly from one end of the housing, which are shaped and spaced relative to one another to engage the first, second, and third receptacle contacts in said electrical outlet box, respectively;

fourth, fifth and sixth contact members secured within the adapter housing at an opposite end thereof from said first, second and third contact prongs and spaced the same as the first, second and third contact prongs, respectively, the adapter housing and the fourth, fifth and sixth contact members constituting another receptacle for receiving a single phase, three prong, polarized electric plug;

a first electrically conductive connecting line for connecting the first contact prong and the fourth contact member, which includes an overcurrent protection means in said first electrically conductive connecting line for opening the first connecting line upon the occurrence of an overcurrent flowing therethrough, and a reset means for resetting said overcurrent protection means upon opening, second and third electrically conductive connecting lines for connecting the second and third contact prongs with the fifth and sixth contact members, respectively;

first and second resilient engaging means, disposed on opposite sides of the housing, for engaging the safety plug adapter with the face plate, the first and second engaging means having first ends affixed to the housing, and second ends for resiliently engaging the first and second flanged portions, respectively, of the face plate assembly; and restraining means, affixed to the adapter housing, for holding an electrically insulating cover means against the opposite end of the adapter housing relative to said prongs in a position at which the adapter receptacle openings are covered by the cover means.

2. A combination, as described in claim 1, wherein the cover means is a single phase electric cord plug which is inserted into the adapter receptacle, and the restraining means comprises at least one elongate flexible member having one end affixed to the adapter housing and an opposite end adapted for connection to the electric cord adjacent the plug thereof to prevent removal of said plug.

3. A combination, as described in claim 1, wherein:

the cover means is a receptacle cover plate which is movably disposed on the adapter housing at the opposite end thereof;

the safety plug adapter further comprises guide means, disposed at the opposite end of the adapter housing, for movably connecting the receptacle cover plate to the adapter housing for movement between a closed position at which the receptacle cover plate covers the adapter receptacle openings and an opened position at which an electric cord plug may be inserted into the adapter receptacle; and the restraining means comprises spring means for exerting a bias force on the receptacle cover plate to maintain the receptacle cover plate in its closed position.

4. A combination, as described in claim 3, wherein the safety plug adapter further comprises at least one elongate flexible member having one end affixed to the adapter housing and an opposite end adapted for connection to an electric cord having a connection plug inserted into the adapter receptacle.

5. A combination, as described in claim 1, wherein the safety plug adapter further comprises voltage-actuated, light emitting means, disposed on one side of the adapter housing and electrically connected between the first and second contact prongs for indicating voltage therebetween.

6. A combination, as described in claim 5, wherein the safety plug adapter further comprises a fuse disposed in the second connecting line having a higher current rating than the overcurrent protection means.

7. A combination, as claimed in claim 6, in which: said adapter includes a second light emitting means which is electrically connected to said first connecting line between said overcurrent protection means and said fourth contact member, and to said second connecting line between said fuse and said fifth contact member in order to determine operability of said fuse and said overcurrent protection means.

8. A combination, as described in claim 1, wherein the safety plug adapter further comprises a fuse disposed in the second connecting line having a higher current rating than the overcurrent protection means.

9. A combination, as described in claim 1, wherein the first connecting line of the safety plug adapter further comprises switch means connected in series with the overcurrent protection means.

10. A combination, as described in claim 1, wherein the overcurrent protection means is a switching means which is actuated by an overcurrent flowing therethrough to open the first connecting line, the switching means including a manual re-set button extending through an opening defined by the adapter housing on one side thereof.

11. A combination, as described in claim 1, wherein the overcurrent protection means is a fuse.

* * * * *